United States Patent [19]

Pease

[11] Patent Number: 4,773,823

[45] Date of Patent: Sep. 27, 1988

[54] CENTRIFUGAL PUMP HAVING IMPROVEMENTS IN SEAL LIFE

[75] Inventor: Roy Pease, Santa Ana, Calif.

[73] Assignee: Tolo, Inc., Santa Ana, Calif.

[21] Appl. No.: 845,324

[22] Filed: Mar. 28, 1986

Related U.S. Application Data

[63] Continuation of Ser. No. 670,758, Nov. 13, 1984, abandoned.

[51] Int. Cl.[4] ..... F04D 29/58

[52] U.S. Cl. ..... 415/177; 415/176

[58] Field of Search ..... 415/175, 176, 180, 169 R, 415/169 A, 121 G, 177–179, 200

[56] References Cited

U.S. PATENT DOCUMENTS

| | | | |
|---|---|---|---|
| 1,386,816 | 8/1921 | Vincent | 415/111 |
| 1,410,644 | 3/1922 | Bentley | 415/177 |
| 1,846,565 | 2/1932 | Meyer | 415/178 |
| 2,741,991 | 4/1956 | Disbrow | 415/180 |
| 2,801,821 | 8/1957 | Burger | 415/177 |
| 2,985,108 | 5/1961 | Stoner et al. | 415/111 |
| 3,102,490 | 9/1963 | Shiley | 415/180 |
| 3,185,101 | 5/1965 | Brooks et al. | 415/176 |
| 3,545,890 | 12/1970 | Hubbard et al. | 415/177 |
| 3,788,762 | 1/1974 | Partos | 415/170 A |
| 3,876,327 | 4/1975 | Lobanoff | 415/200 |
| 3,936,220 | 2/1976 | Henderson | 415/178 |
| 3,958,894 | 5/1976 | Rowley et al. | 415/121 G |
| 4,114,899 | 9/1978 | Kulzer et al. | 415/177 |
| 4,376,617 | 3/1983 | Okano et al. | 415/178 |

FOREIGN PATENT DOCUMENTS

| | | | |
|---|---|---|---|
| 887534 | 11/1943 | France | 415/177 |
| 149307 | 12/1960 | U.S.S.R. | 415/111 |
| 500007 | 2/1939 | United Kingdom | 415/177 |

*Primary Examiner*—Robert E. Garrett
*Assistant Examiner*—John T. Kwon
*Attorney, Agent, or Firm*—Louis J. Bachand

[57] ABSTRACT

Longer shaft seal life in centrifugal pumps is realized by returning liquid from the pressure side of the pump to the seal area via a passage formed in a rib of the housing wall, and without porting the impeller, so that pump efficiency is kept high and its self-priming ability is retained.

5 Claims, 1 Drawing Sheet

3
3
4
4
P
M

CENTRIFUGAL PUMP HAVING IMPROVEMENTS IN SEAL LIFE

This application is a continuation, of application Ser. No. 670,758, filed 11/13/84 now abandoned.

This invention has to do with centrifugal pumps, and more particularly with improvements in centrifugal pumps providing longer shaft seal life, through the more efficient cooling of the seal. The invention is particularly concerned with modifications of conventional centrifugal water pumps such as used in recreational pools to obtain longer seal life, less leaking failure and at the same time maintain pump efficiency and the ability to self-prime.

BACKGROUND OF THE INVENTION

Recreational pools such as swimming pools and spas and many other liquid handling systems use centrigual pumps to move the liquid e.g. through conditioning devices such as filters and heaters. Centrifugal pumps efficiently move liquid by drawing the liquid in at the center of an impeller and expelling it outward, centrifugally, under considerable pressure. The flow direction of the liquid is determined by a housing which encloses the impeller and defines inlet and outlet. The impeller is driven by a motor beyond the pump housing. A shaft from the motor passes through the housing wall to the impeller. A seal is provided between the shaft and the housing wall, typically of a resilient material which through frictional engagement seals the shaft in liquid-tight relation. This seal is subject to premature failure because of heat. Heat from frictional contact at the seal and by conduction along the shaft from the motor may distort the seal material or its support, cause cracking or other seal deterioration, shortened seal life and premature failure.

Previous efforts to lengthen centrifugal seal life have included porting the impeller so that liquid flows to the seal area as a heat sink. This expedient is disadvantageous in that the efficiency of the pump is reduced by such porting, and the ability to self-prime adversely affected. Others have used a good heat conductor as a heat sink in the seal area, such as a copper cup between the housing wall and the seal material. This approach has the disadvantage of introducing a corrodible material into the system, a considerable problem in hostile environments such as swimming pool water.

SUMMARY OF THE INVENTION

It is accordingly an object of the invention to provide an improved centrifugal pump. It is a more particular object to provide in a centrifugal pump a novel means of reducing heat accumulation at the shaft seal, without efficiency-losing porting of the impeller or introducing a corrodible material.

It is a further object to provide through the pump housing a directional application of liquid to the shaft seal area in a centrifugal pump.

These and other objects of the invention to become apparent hereinafter are realized in accordance with the invention in a centrifugal pump comprising a housing having a wall defining an axial inlet and a peripheral outlet for liquid to be pumped, an impeller rotatably mounted within the housing on a motor-driven shaft for pumping liquid between the inlet and the outlet, the shaft extending through the housing wall, and frictional seal means between the housing wall and the shaft, the seal means tending prematurely to fail from the presence of excess heat during pump operation, the impeller defining with the housing a low pressure chamber adjacent the seal means and a high pressure chamber adjacent the outlet, the improvement comprising a housing wall-defined passage communicating the high pressure chamber with the low pressure chamber, whereby liquid from the high pressure chamber is expelled into the low pressure chamber and onto the seal means therein to remove excess heat from the seal means and reduce premature seal means failures thereby.

In particular embodiments, the housing wall comprises synthetic organic plastic; the impeller comprises synthetic organic plastic; the frictional seal means comprises a resilient material liquid tightly engaged between the shaft and the housing wall; and the passage is tubular and is angularly disposed relative to the shaft for directing liquid within the passage toward the seal.

In a preferred embodiment of the centrifugal pump according to the invention the housing wall includes at least one rib extending between the low pressure chamber and the high pressure chamber, the passage being formed by the rib. In this and like embodiments, typically, the housing wall comprises synthetic organic plastic; the impeller comprises synthetic organic plastic; the frictional seal means comprises a resilient material liquid-tightly engaged between the shaft and the housing wall; the rib is angularly disposed relative to the shaft, and the passage is tubular and lies within the rib for angularly directing liquid toward the seal.

In a highly particularly preferred embodiment, there is provided a centrifugal pump for swimming pool water or the like comprising a synthetic organic housing, an impeller within the housing, a shaft carrying the impeller, a seal between the shaft and the housing subject to conduction and friction heating during operation of the pump, a high water pressure chamber at the output side of the impeller, a low pressure chamber at the shaft seal side of the impeller, and means communicating water within the high pressure chamber with the low pressure chamber comprising a direct passage between the chambers defined by a portion of the housing, whereby water contraflows within the housing and to the seal area in seal heat ameliorating relation.

THE DRAWINGS

The invention will be further described as to an illustrative embodiment in connection with the attached drawings in which.

PREFERRED MODES

Figures 1, 2, 3, 4:
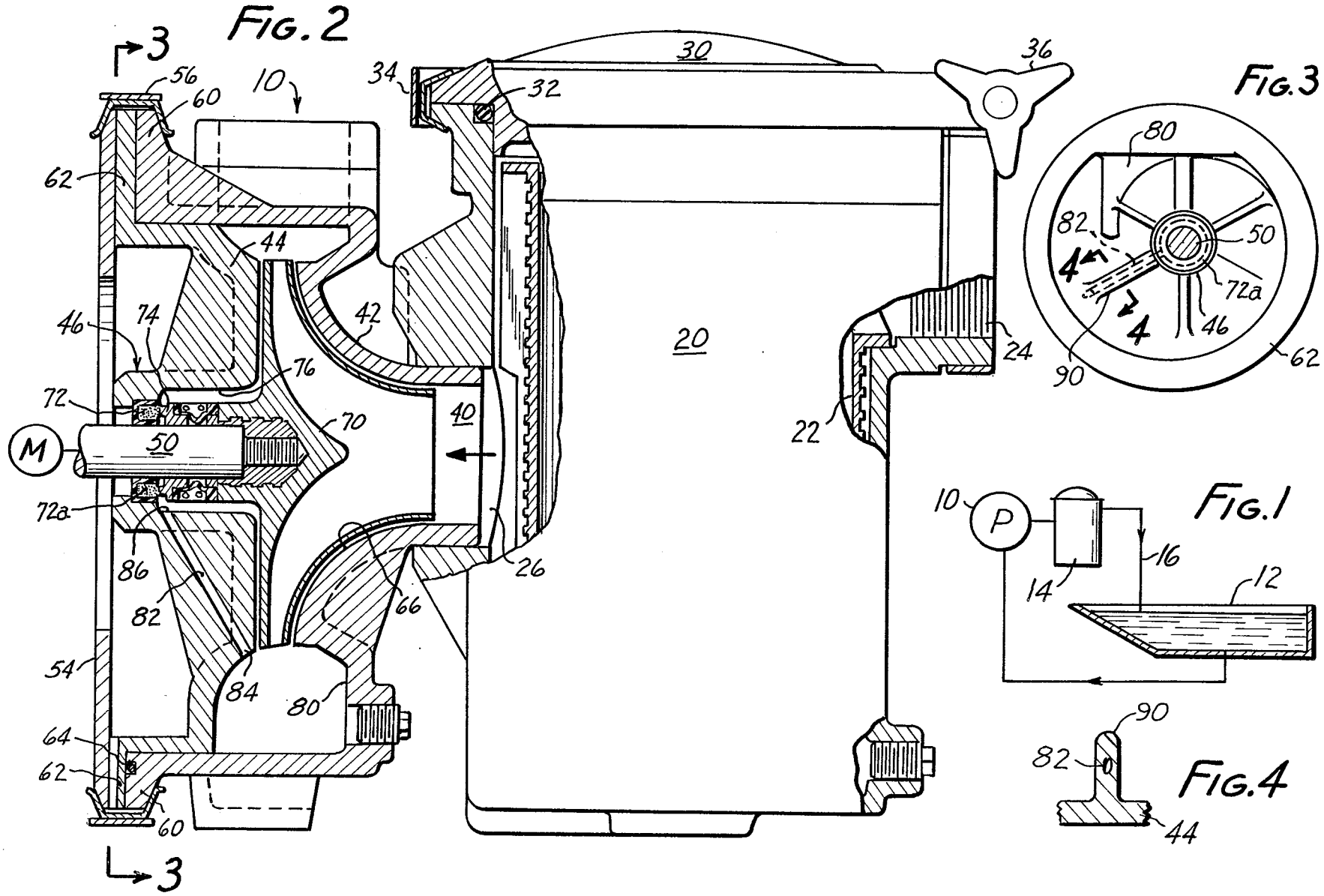
FIG. 1 is a schematic view of a recreational pool water circulation system in which the present invention pump is highly advantageous.
FIG. 2 is a view in the horizontal section of the pump according to invention, partly broken away to show underlying parts.
FIG. 3 is a view taken on line 3—3 in FIG. 2 and reduced.
FIG. 4 is a fragmentary detail view of the housing rib with the passage defined therein.

Accordingly the foregoing objects of the invention to provide a novel means of coupling tubular elements together in a manner to be water-tight, to be easily assembled in the first instance and to be readily readjusted if necessary.

The present centrifugal pumps afford longer shaft seal life by returning liquid from the pressure side of the pump to the seal area via a passage formed in the housing wall, e.g. in a radial rib thereof. The liquid acts as a heat sink for the shaft seal. The impeller is not ported so as to lose efficiency or self-priming ability.

Referring now to the drawing in detail in FIG. 1 the pump of the invention is depicted at 10 and serves to circulate water from swimming pool 12 through the filter 14 and back to the pool via piping 16.

In FIG. 2 the pump 10 is shown in detail connected to leaf pot 20 having an internal leaf basket 22, an inlet 24 and an outlet 26. Leaf pot cover 30 and O-ring seal 32 are secured to leaf pot 20 by V-clamp 34 closed with nut 36.

The inlet 40 of the pump 10 is formed by front wall 42 of the pump and communicates with outlet 26 of the leaf pot. Rear wall 44 completes the pump housing and defines a hub 46 in which shaft 50 is rotatably received, sealed by the seal system described below. The shaft 50 is driven by a motor shown schematically.

Housing front wall 42 and rear wall 44 are coaxially disposed and assembled, secured to plate 54 by V-clamp 56, by their peripheral flanges 60, 62, respectively, and sealed by O-ring 64.

Front and rear housing walls 42, 44, jointly define a cavity 66 in which impeller 70 is disposed. Impeller 70 is thread-connected to shaft 50 for rotation therewith. The shaft seal is formed between fixed seal element 72 having a replaceable seal material 72a and spring loaded rotating seal element 74.

The shaft seal 72, 74 is the area of the centrifugal pump which builds up undue heat through friction and conduction of heat along the shaft 50 from the motor.

The shaft seal 72, 74 is disposed within cavity 66 and specifically in chamber 76, a low pressure chamber since it is behind the impeller 70. On the other hand, the portion of cavity 66 lying radially of the impeller 70, constituting the pump volute 80, is a high pressure chamber.

In the present invention, the high pressure chamber volute 80, is communicated with the low pressure chamber 76 which surrounds the seal 72, 74 by means of a passage 82 which has an inlet 84 open to the volute 80, and therefore at high water pressure, and an outlet 86 open to the low pressure chamber 76 and therefore at low water pressure, the pressure differential across passage 82 causes water to be directed from the volute 80 into the chamber 76 and toward the seal 72, 74 immersed in the hydraulically full chamber 76.

The passage 82 in accordance with the invention is advantageously located in the housing wall rib 90.

Forming the passage 82 may conveniently be effected by drilling at an angle through the rib.

Use of the rib 90 and thus the housing rear wall 44 enables the passage 82 to be stationary to eliminate flow problems inherent in rapidly rotating bodies, and avoids porting or other modification of the impeller 70, which, as noted above, can result in loss of pumping efficiency and inability to self-prime.

The described improved pump has been found to enjoy longer shaft seal 72, 74 life because of the enhanced cooling effected at the seal by the water flow through the housing wall rib 90.

The aforementioned objects are thus realized including provision directional application of liquid to the shaft seal of an improved centrifugal pump having reduced heat build-up of the shaft seal and free of impeller porting.

Having thus described the best mode known to me for carrying out my invention, is not to be limited to the illustrative embodiments herein, but only in accordance with the following claims.

I claim:

1. In a centrifugal pump comprising a housing having a wall defining an axial inlet, a peripheral outlet for liquid to be pumped, and a cavity therebetween, a straight rib extending to said wall outside of said housing and parallel to said axial inlet, an impeller rotably mounted within the housing cavity on a motor-driven shaft for pumping liquid between said inlet and said outlet, said shaft extending through the housing wall, and frictional seal means between said housing wall and said shaft, said seal means tending prematurely to fail from the presence of excess heat during pump operation, said imperller defining with said housing a low pressure chamber adjacent said seal means and a high pressure chamber adjacent said outlet, the improvement comprising a passage formed entriely within said housing rib, said passage communicating said high pressure chamber from a point outward beyond the periphery of said impeller along a straight line path with said low pressure chamber, whereby liquid from said high pressure chamber is directed into said low pressure chamber directly onto said seal means along a continuation of said straight line path beyond said passage to remove excess heat from said seal means and reduce premature seal means failures thereby.

2. Centrifugal pump according to claim 1, in which said housing wall comprises synthetic organic plastic.

3. Centrifugal pump according to claim 1, in which said impeller comprises synthetic organic plastic.

4. Centrifugal pump according to claim 1, in which said frictional seal means comprises a resilient material engaged between said shaft and said housing wall.

5. Centrifugal pump for swimming pool water or the like comprising a synthetic organic plastic housing, an impeller with the housing, a shaft carrying said impeller, a seal between said shaft and said housing subject to convection and friction heating during operation of the pump, a high water pressure chamber at the output side of said impeller, a low pressure chamber at the shaft seal side of said impeller, means communicating water within said high pressure chamber with said low pressure chamber, said communicating means comprising a straight passage between said chambers at an angle other than zero or 90 degrees to said shaft and define within an axial rib portion of said housing from a point outward of the periphery of said impeller, whereby water contraflows within said housing and to said seal area in seal heat ameliorating relation

* * * * *